US005129550A

United States Patent [19]

Eschbach

[11] Patent Number: 5,129,550

[45] Date of Patent: Jul. 14, 1992

[54] SPRAY BOTTLE APPARATUS WITH FORCE MULTIPLY PISTONS

[75] Inventor: Eugene A. Eschbach, Richland, Wash.

[73] Assignee: Battelle Memorial Institute, Richland, Wash.

[21] Appl. No.: 596,848

[22] Filed: Oct. 12, 1990

Related U.S. Application Data

[63] Continuation-in-part of Ser. No. 300,601, Jan. 23, 1989, Pat. No. 4,972,977.

[51] Int. Cl.[5] ..... B65D 37/00

[52] U.S. Cl. ..... 222/135; 222/145; 222/207; 239/327

[58] Field of Search ..... 222/135, 137, 145, 207, 222/209, 211; 239/327, 323, 322, 321; 92/35

[56] References Cited

U.S. PATENT DOCUMENTS 3,162,335 12/1964 Kogan et al. ..... 92/35
4,603,794 8/1986 Deford et al. ..... 239/327
4,826,048 5/1989 Skorka et al. ..... 222/137
4,972,977 12/1990 Moss et al. ..... 222/207

*Primary Examiner*—Michael S. Huppert
*Attorney, Agent, or Firm*—Stephen R. May

[57] ABSTRACT

The present invention comprises a spray bottle in which the pressure resulting from the gripping force applied by the user is amplified and this increased pressure used in generating a spray such as an aerosol or fluid stream. In its preferred embodiment, the invention includes a high pressure chamber and a corresponding piston which is operative for driving fluid out of this chamber at high pressure through a spray nozzle and a low pressure chamber and corresponding piston which is acted upon by the hydraulic pressure within the bottle resulting from the gripping force. The low pressure chamber and piston are of larger size than the high pressure chamber and piston. The pistons are rigidly connected so that the force created by the pressure acting on the piston in the low pressure chamber is transmitted to the piston in the high pressure chamber where it is applied over a more limited area thereby generating greater hydraulic pressure for use in forming the spray.

6 Claims, 6 Drawing Sheets

SPRAY BOTTLE APPARATUS WITH FORCE MULTIPLY PISTONS

CROSS REFERENCE TO RELATED APPLICATIONS

This Application is a continuation-in-part application of co-pending U.S. application Ser. No. 300,601, filed Jan. 23, 1989, now U.S. Pat. No. 4,972,977.

BACKGROUND OF THE INVENTION

The present invention relates to devices for dispensing fluids and more particularly to squeeze bottles designed to provide sprays of fluid materials.

The high pressures which can be provided by fluorocarbon propellants have been usefully employed in generating finely divided aerosol sprays which are relatively uniform in consistency and which are produced with little effort on the part of the user. However, in recent years the use of fluorocarbon propellants for powering aerosol dispensers has become a matter of concern as the environmental effects of such compounds have become clear. Consequently, it has become important to develop alternative methods of generating aerosol and other types of sprays.

Unfortunately, most mechanically operated spray bottles do not allow significant amounts of fine spray to be generated without application of substantial gripping force by the user. Thus, if the user does not have the ability to apply a substantial force, it is not possible for him to produce a satisfactory spray. Furthermore, the difficulties inherent in applying a steady force to a squeeze bottle often result in non-uniform or coarse spray patterns along with sputtering of the fluid.

It is therefore an object of the present invention to provide an improved spray bottle which is capable of dispensing significant amounts of a fluid stream or a finely divided spray in uniform patterns.

It is another object of the present invention to provide an improved spray bottle mechanism which amplifies the pressure resulting from the gripping force applied by the user and which employs the increased pressure so derived in generating a satisfactory spray.

It is a further object of the present invention to provide an improved dispensing pump for a spray bottle which is operative for developing a mechanical advantage when in use which allows for the amplification of the available hydraulic pressure.

It is yet another object of the present invention to provide an improved spray bottle which can be easily utilized by all types of users regardless of their gripping strength and which generates either a satisfactory aerosol spray or the mixing of disparate fluids upon the application of a limited amount of gripping force by the user.

It is a yet further object of the present invention to provide an improved spray bottle mechanism which is relatively simple in design, economical to construct, reliable in service and which can serve as an effective alternative to aerosol cans using fluorocarbon propellants.

SUMMARY OF THE INVENTION

The present invention relates to a system for generating a spray of a fluid material held within a sealed container constructed of a resilient material by "stepping up" the pressure produced within the container when it is manually squeezed and using the increased pressure so produced in generating the spray. The invention comprises a dispensing pump which is mounted on the container including a housing defining two separate chambers and a hydraulic assembly having a pair of pistons which operate within these chambers. One piston is of comparatively large diameter and this piston is driven in its corresponding chamber by the pressure within the container while the chamber itself is vented to the atmosphere. The other piston is of comparatively small diameter and is structurally connected to the larger piston so as to be driven by the force generated by the pressure acting on the large piston. The chamber corresponding to the small piston is associated with valve and fluid supply mechanisms which allow for fluid to be driven out of this chamber under increased pressure when the container is squeezed and for fluid to be charged into this chamber as the container recovers from being squeezed and resumes its original shape.

The operation of the pistons within their corresponding chambers results in the hydraulic pressure within the container being amplified and applied to a charge of fluid within the small chamber which can then be driven out through the nozzle at high pressure and efficiently ejected thereby producing a "media" of the fluid such as an aerosol spray of fluid stream.

In the preferred embodiment, the chambers are coaxially aligned and the pistons comprising the hydraulic assembly form a single structural unit. Fluid is supplied to the smaller chamber by way of a conduit through the center of the hydraulic assembly and a fluid supply tube which extends down into the fluid residing in the container. Fluid flow is controlled by two check valves mounted between the smaller chamber and the nozzle and between the supply tube and the fluid within the container. This arrangement provides for a particularly compact and efficient design allowing the dispensing pump to be conveniently mounted within the neck of the container holding the fluid to be ejected.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
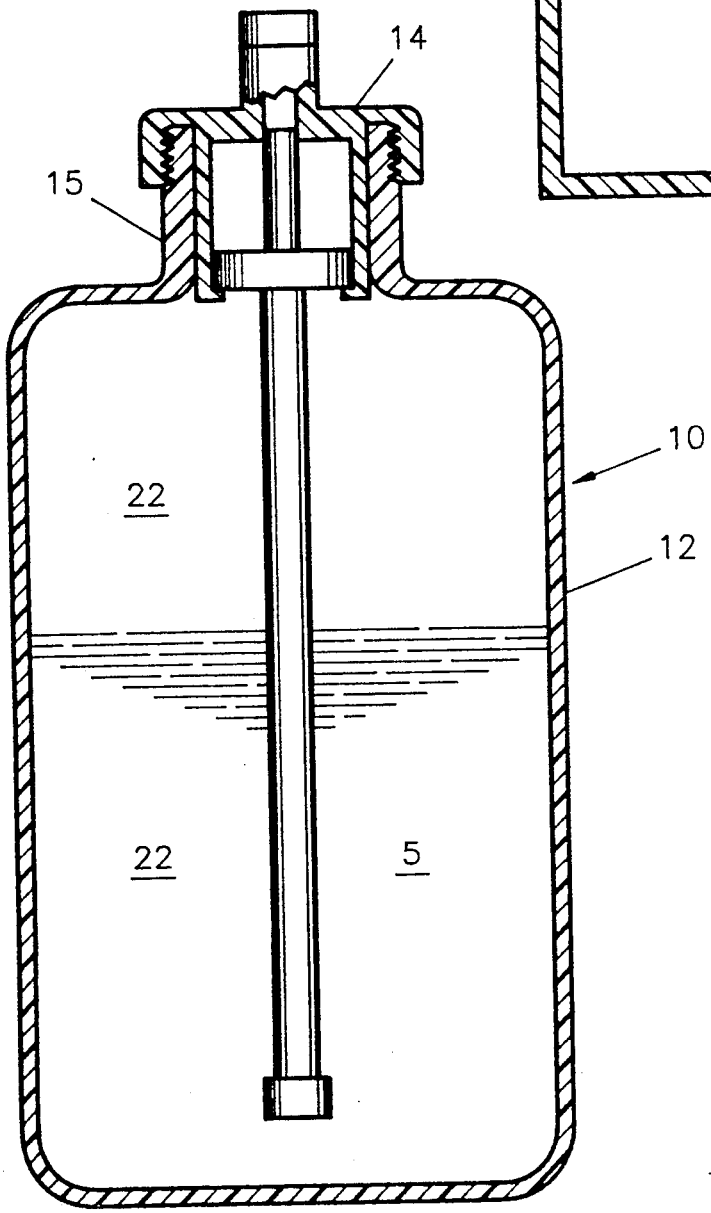
FIG. 1 is an overall cross-sectional view of one embodiment of the present invention showing how the dispensing pump component is installed in a resilient container.

Referring now to FIG. 1, one embodiment of the present invention is shown in the form of the spray bottle 10 comprising a deformable and resilient container 12 and a dispensing pump 14 mounted on this container for producing an aerosol type spray of liquid 5 resident within the interior 22 of the container 12. The container 12 is constructed of a plastic, such as a polyethylene, and can be readily deformed by hand pressure but rapidly returns to its original shape when such pressure is released. The dispensing pump 14 is designed for being secured within the neck 15 of the container 12 and extends from above the top of the container 12 down toward the bottom of the interior 22 of the container 12.

Figure 2A:
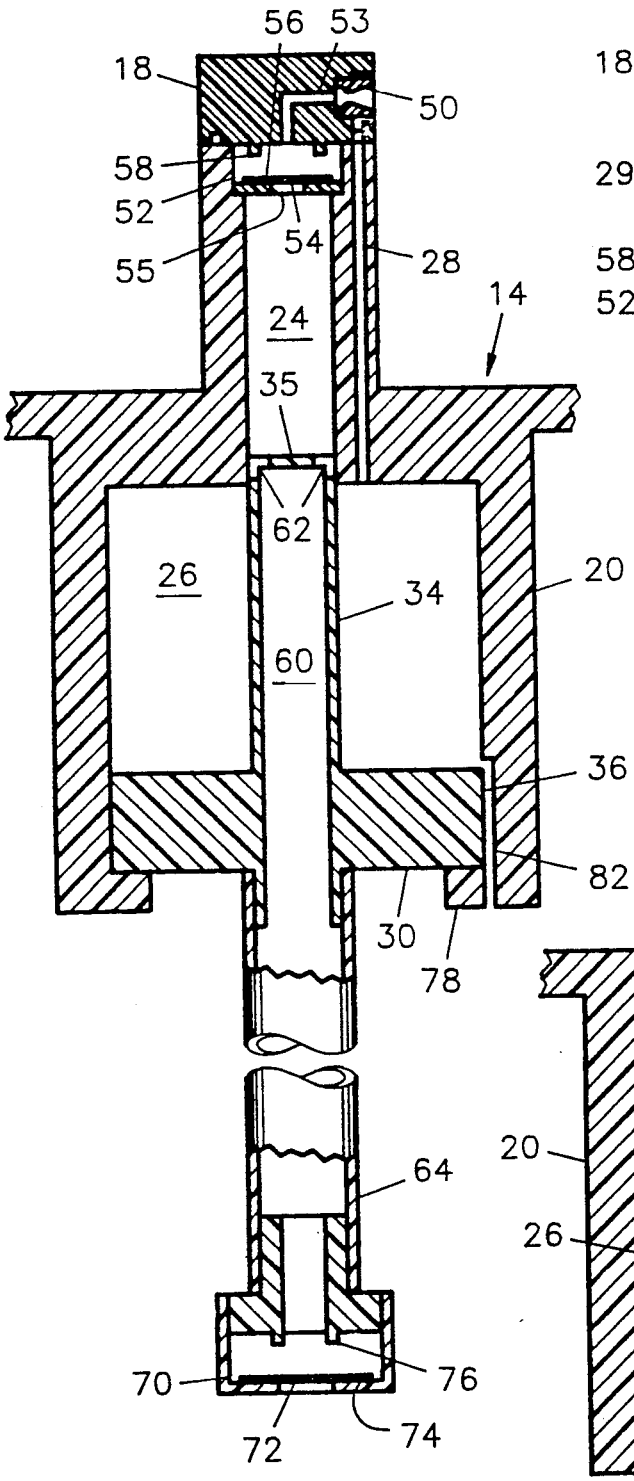
FIG. 2A is a detailed cross-sectional view of the dispensing pump component of the embodiment of the present invention shown in FIG. 1 with the hydraulic assembly element in its starting or rest position prior to the spray bottle being squeezed.
Figure 2C:
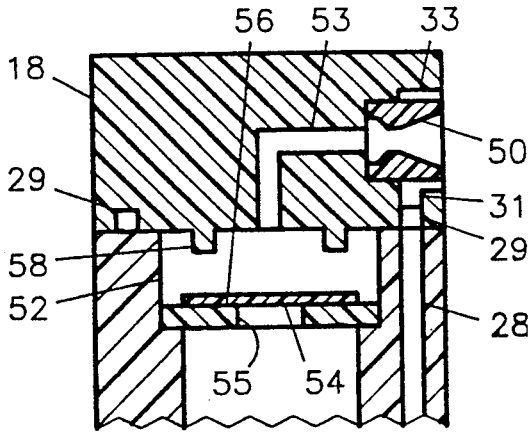
FIG. 2C is a detailed cross-sectional view of the dispensing member component associated with the present invention.
Figure 2B:
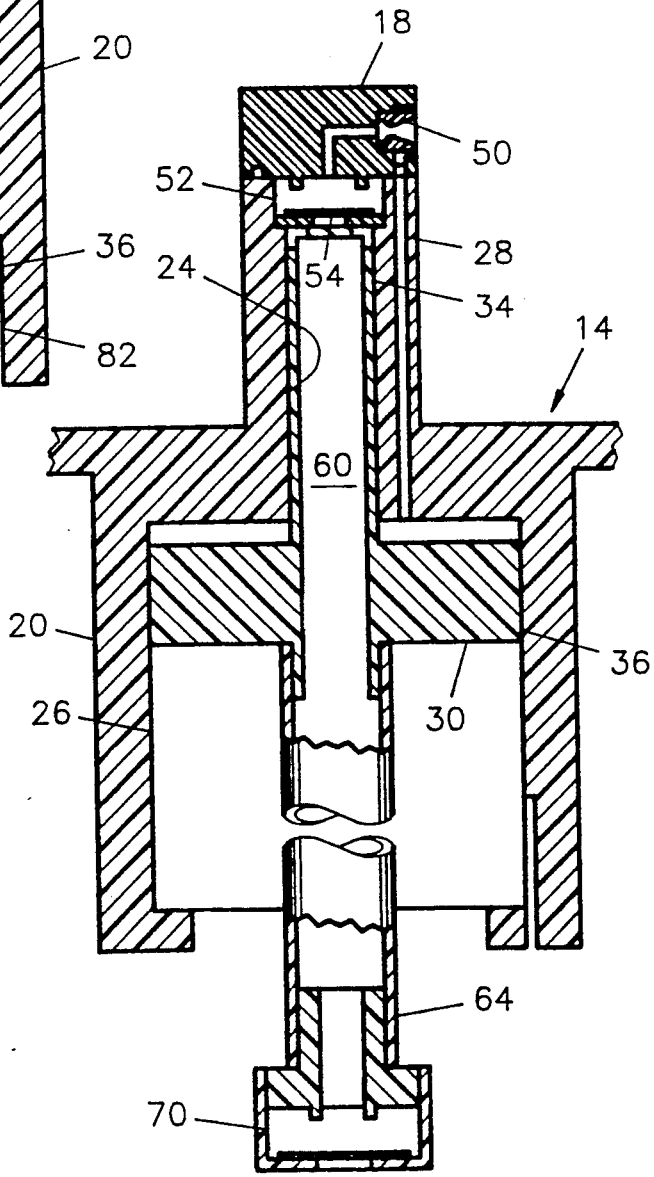
FIG. 2B is a detailed cross-sectional view of the dispensing pump component of the embodiment of the present invention shown in FIG. 1 with the hydraulic assembly element in its end position after the spray bottle has been squeezed.

Referring now to FIGS. 2A, 2B and also 2C, the dispensing pump 14 is shown in greater detail along with the discharge member 18 associated with it. The dispensing pump 14 includes the housing 20 and the hydraulic assembly 30, the housing 20 defining a high pressure chamber 24 which is cylindrical in shape and a low pressure chamber 26 which also has a cylindrical shape and is coaxially aligned with the chamber 24. The high pressure chamber 24 is of a substantially smaller diameter than the low pressure chamber 26. The high pressure chamber 24 communicates in a controlled manner with the atmosphere exterior to the container 12 through a nozzle 50 in the discharge member 18, while the low pressure chamber 26 communicates with the atmosphere through one or more vent tubes 28 and passages connecting thereto. The hydraulic assembly 30 includes a piston 34 designed to operate within the chamber 24 and a piston 36 designed to operate within the chamber 26. The pistons 34 and 36 are constructed so as to sealingly engage the interior walls of the chambers 24 and 26, respectively. The piston 34 therefore separates and seals off the chamber 24 from the chamber 26 while the piston 36 partitions off the interior of the chamber 26 above the piston 36 from the interior 22 of the container 12. In accordance with the diameters of the chambers 24 and 26, the piston 34 is of substantially lesser diameter than the piston 36. Since piston 34 is rigidly connected to the piston 36, forces acting on the piston 36 are transferred directly to the piston 34. In the embodiment shown and described the pistons 34 and 36 are designed as a single structural unit constituting the hydraulic assembly 30.

The discharge member 18 is mounted on the upper end of the chamber 24 and includes nozzle 50 by means of which liquid may be ejected from the chamber 24 through the action of the piston 34 and laterally dispensed from the spray bottle 10. A check valve 52 is located between the nozzle 50 and the chamber 24 and includes a disk-shaped flapper plate 54 mounted between a valve seat 56 and a set of raised bumps or spurs 58 surrounding the passageway 53 to the nozzle 50. The check valve 52 allows one way fluid flow out from the chamber 24 through the nozzle 50 but prevents flow of air through the nozzle 50 into the chamber 24, thereby serving to maintain fluid within the chamber 24. The hydraulic assembly 30 further includes a conduit 60 in the form of a hollow core extending centrally through the pistons 34 and 36 along the axis on which the pistons are aligned and which is connected to the supply tube 64 at the bottom of the hydraulic assembly 30. The supply tube 64 is constructed of a flexible plastic and extends down toward the bottom of the container 12 projecting into the liquid 5 residing within the container 12. The conduit 60 and supply tube 64 function to allow liquid flow up through delivery vents 62, at the outside edge of the top of piston 34, into chamber 24 from the bottom of container 12. A check valve 70 is mounted on the bottom end of the tube 64 so as to be submerged in the liquid 5 within the container 12. The check valve 70 is similar in construction to the check valve 52 and includes a disk-shaped flapper plate 72 mounted between a valve seat 74 and a set of bumps or spurs 76. The check valve 70 functions to allow fluid flow up through the supply tube 64 and delivery vents 62 into the chamber 24 but prevents any flow of fluid back down from the chamber 24 through the conduit 60 and the tube 64 into the interior 22 of the container 12.

Vent tubes 28 extend up through the housing 20 from the area of the chamber 26 above the piston 36 to the atmosphere outside the container 12 and function to allow this part of the chamber 26 to be continuously maintained at atmospheric pressure. A liquid return vent 82 connects the interior of the chamber 26 above piston 36 to interior 22 of the container 12 when the hydraulic assembly 30 is in its lower most position (as shown in FIG. 2A) in order to allow any stray liquid within the chamber 26 to drain into the interior 22 of the container 12 under the influence of gravity. Retaining ring 78 extends inwardly from the housing 20 below the chamber 26 and functions to prevent the hydraulic assembly 30 from becoming disengaged from the housing 20 during use.

In operation, the hydraulic assembly 30 moves up and down within the housing 20 in response to changes in the pressure level within the container 12. When the user squeezes the spray bottle 10, this action causes the hydraulic pressure within the container 12 to increase by some amount (above gauge pressure) which may on average be in the range of 1–4 lbs./in. This pressure is applied to the lower surface of the piston 36 and exerts a force on the piston equal to the cross-sectional area of the piston times this pressure. Because the piston 34 is rigidly connected to the piston 36, the force generated by the hydraulic pressure within the container 12 acting on the piston 36 is transmitted through the structure of the hydraulic assembly 30 to the piston 34 and is applied to the fluid within the chamber 24. However, this force acts over a more limited area corresponding to the lesser cross-section of the piston 34. Since the hydraulic pressure generated within the chamber 24 is equal to the force divided by the area over which it operates, a comparatively high hydraulic pressure is generated within the chamber 24. Fluid may thereby be driven out of the chamber 24 at high pressure through the nozzle 18 and a satisfactory spray such as a finely divided aerosol generated. It should be noted that as fluid is being ejected from the chamber 24 any backward flow of fluid out of the chamber 24 through the vents 62 is prevented by the check valve 70.

As the spray bottle 10 is squeezed, a spray of fluid is continuously generated until the hydraulic assembly 30 fully engages the upper part of the housing as shown in FIG. 2B and the top 35 of the piston 34 seals off the port 55 to the check valve 52. When the user releases his grip on the spray bottle 10 and the container 12 recovers its original shape, the hydraulic assembly 30 is gradually drawn down toward its lower most (starting) position out of engagement with the upper part of the housing 20. During this process, air flows from the atmosphere through the vent tubes 28 into the chamber 26. Meanwhile, liquid material flows up through the check valve 70, supply tube 64 and conduit 60 and finally through delivery vents 62 into the chamber 24 effectively recharging this chamber 24 for the next cycle of spray production which will occur when the spray bottle 10 is again squeezed. It should be noted that as the chamber 24 is being recharged with fluid any flow of air into the chamber 24 through the nozzle 18 is prevented by the check valve 52.

Referring now specifically to FIG. 2C, the discharge member 18 includes an annular groove 29 which intersects the vent tubes 28 and provides a connecting passageway between vent tubes 28 and the conduit 31 regardless of the alignment of the discharge member 18 with the vent tubes 28. The conduit 31 leads to an annular air discharge channel 33 which surrounds the nozzle 50 and through which comparatively large volumes of air coming out from the chamber 26 may be discharged as fluid is dispensed from the nozzle 50. This air helps to entrain the fluid exiting the nozzle 50 and disperse it.

Figure 3:
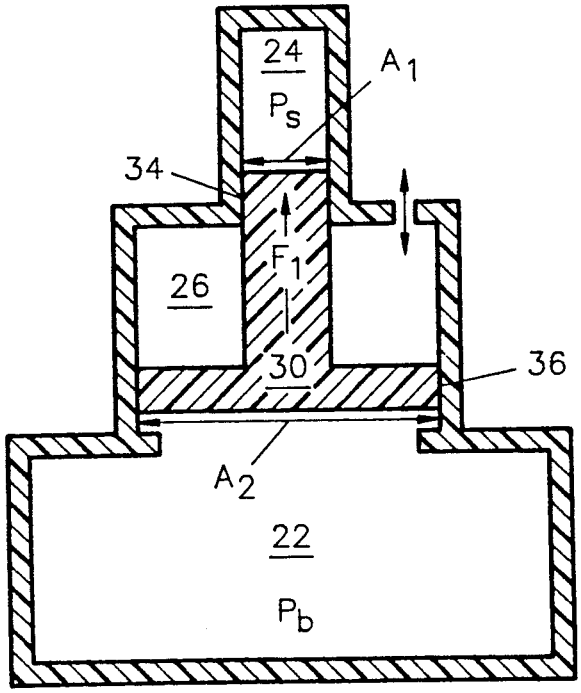
FIG. 3 is a diagrammatic cross-sectional view of a simplified model of the present invention whereby the operation of the invention can be conveniently explained with reference to static conditions.

The principles of operation of the present invention may be explained with reference to the simplified model shown in FIG. 3 which depicts the components of the present invention under static conditions. The pressures within the areas of chambers 24 and 26 above the pistons 34 and 36 and their relationship to the position of the hydraulic assembly 30 and the pressure within the interior 22 of the spray bottle 10 are the key factors in the operation of the present invention. The pressure $P_b$ within the container 12 of the spray bottle 10 which is generated as a result of the bottle being squeezed is exerted over a large area corresponding to the diameter of the piston 36 resulting in a substantial force $F_1$ being generated. This force $F_1$ is equal to the pressure $P_b$ times the cross-sectional area $A_2$ of the piston 36 or $F_1 = P_b A_2$.

However, since no counteracting pressures exist within the chamber 26, this entire force $F_1$ is transmitted through the hydraulic assembly 30 and exerted by the piston 34 exclusively on the fluid within the chamber 24. This force $F_1$ is applied over a comparatively small area corresponding to the diameter of the piston 34 thereby achieving a mechanical advantage or what in the present case may be termed a "hydraulic advantage". The resulting pressure $P_s$ is equal to the force $F_1$ divided by the cross-sectional area $A_1$ of the piston 34 or $P_s = F_1/A_1$. A comparatively large pressure $P_s$ is generated since (by substitution of $P_b A_2$ for $F_1$), $P_s = P_b(A_2/A_1)$ and the ratio $A_2/A_1$ is large because $A_2 >> A_1$. Fluid may thereby be driven out of the chamber 24 under higher pressure $P_s$ through a nozzle and a highly satisfactory aerosol or fluid stream type spray produced.

In the actual use of a spray bottle incorporating the present invention such as the spray bottle 10 shown in FIG. 1, the ratio $R_p$ of the pressure within the chamber 24 to the pressure within the bottle 10 may approach the ratio $A_2/A_1$ of the effective areas of the pistons 36 and 34. In the preferred embodiment, the ratio $R_p$ is preferably about 10–15 to 1 so that if the bottle 10 is pressed with a force resulting in two pounds of pressure within the container 12, approximately 20 to 30 lbs./in. of pressure may be generated within the chamber 24 for driving the fluid out through the nozzle 50. This phenomenon is very useful since only a limited amount of hand pressure or compressive force is necessary to provide a substantial amount of hydraulic pressure as required for generating a useful spray. Furthermore, since relatively large compressive forces would otherwise be required to generate satisfactory sprays, the present invention allows users having a relative gentle grip to utilize the spray bottle device. Additionally, the present invention allows a more uniform spray patterns to be produced since pressures above 15 lbs./in. which are readily obtainable with the present invention tend to provide more uniform spray patterns regardless of the exact pressure level and since the modest amount of gripping force required in using the present invention is much easier to apply in a controlled manner.

The parts for the spray bottle 10 of the present invention may be manufactured from a high impact plastic such as polyethylene by conventional injection molding techniques. The proper operation of the dispensing pump 14 requires a good seal between the chambers 24 and 26 and the pistons 34 and 36, respectively. It should be noted that the distance between the delivery vents 62 and the chamber 26 which exists when the hydraulic assembly 30 is in its lower most (starting) position should not be less than 1–2 mm in order to prevent any undue fluid leakage into the chamber 26. Additionally, the check valves 52 and 70 are designed with sufficient clearance between the flapper plates and the ports into and out of these valves in order to allow relatively unrestricted (forward) flow through the valves.

Figure 4:
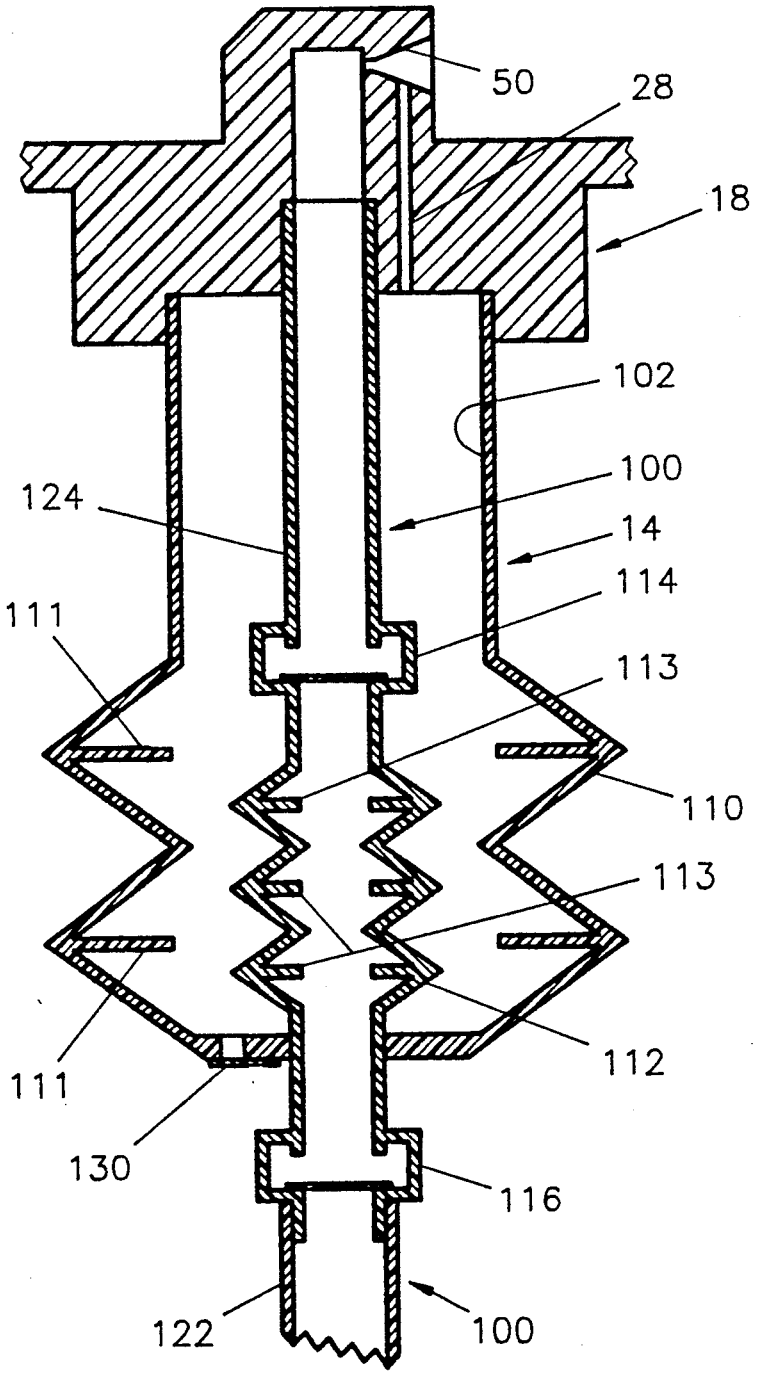
FIG. 4 is a detailed cross-sectional view of the dispensing pump component of an alternative embodiment of the present invention.

Referring now to FIG. 4, an alternative type of dispensing pump 14 in accordance with the present invention which is suitable for handling a variety of fluids including viscous liquids is illustrated as attached to a discharge member 18. The discharge member 18 is adapted for being mounted on a deformable and resilient container 12 (not shown in FIG. 4) within which the fluid to be dispensed is held. The discharge member 18 includes the nozzle 50 by means of which fluid from a fluid supply tube 100 which extends down into the fluid resident within the container 12 may be ejected in the form of a media such as a high velocity fluid stream. The discharge member 18 also includes a vent tube 28 which intersects the nozzle 50 and provides a high-volume flow of air up from the cylindrical chamber 102 which may help to entrain the fluid exiting to nozzle 50.

The dispensing pump 14 of FIG. 4 comprises a large diameter bellows 110 and a small diameter bellows 112 mounted inside of the large bellows 110. The bellows 110 and 112 have a "pleated" shape and are constructed of a resilient material such as neoprene rubber so as to be longitudinally collapsible. The reinforcing rings 111 and 113 are rigid and help maintain the radial shape of the bellows 110 as pressure is applied to them so that they are compressable primarily along their axial dimensions. The small bellows 112 is sized to fit within the bellows 110 and has approximately ⅓ the diameter of the large bellows 112. The small bellows 112 is mounted mid way up the fluid supply tube 100 between an upper check valve 114 and a lower check valve 116. The check valves 116 and 114 allow only one-way fluid flow up through the lower portion 122 of the tube 100 into the bellows 112 and from the bellows 112 into the upper portion 124 of the tube 100. The check valves 114 and 116 include flapper plates mounted between valve seats and a set of spurs and are similar in structure and operation to the check valves 52 and 70 previously described. The bottom end of the large bellows 110 is rigidly affixed to the bottom end of the small bellows 112 so that the bellows 110 and 112 are constrained to expand and contract together in a cooperative fashion. A small check valve 130 is installed on the bottom of the large bellows 110 for allowing stray fluid to drain out of the bellows 110 back into the container 12.

In operation, pressure is exerted on the large bellows 110 when the container 12 on which the dispensing pump 14 of FIG. 4 is mounted is squeezed by the user. Since the interior of the bellows 110 and the chamber 102 are exhausted to the atmosphere through the vent 28 the bellows 110 and 112 are both forced upward in unison by this pressure. During this process the small bellows 112 is compressed with all of the force generated by the pressure acting on the bottom of the bellows 110. Consequently, the pressure of the fluid within the bellows 112 is raised to a level approximately equal to the pressure applied to the container 12 times the ratio of the squares of the diameters of the bellows 110 and 112. Fluid is driven upward at an elevated pressure through the valve 114, tube 100 and nozzle 50 thereby generating a satisfactory spray. When the container 12 is released and recovers its original shape the bellows 110 and 112 expand sucking air in through the vent 28 into the interior of the bellows 110 and recharging fluid into the interior of the bellows 112.

Figure 5:
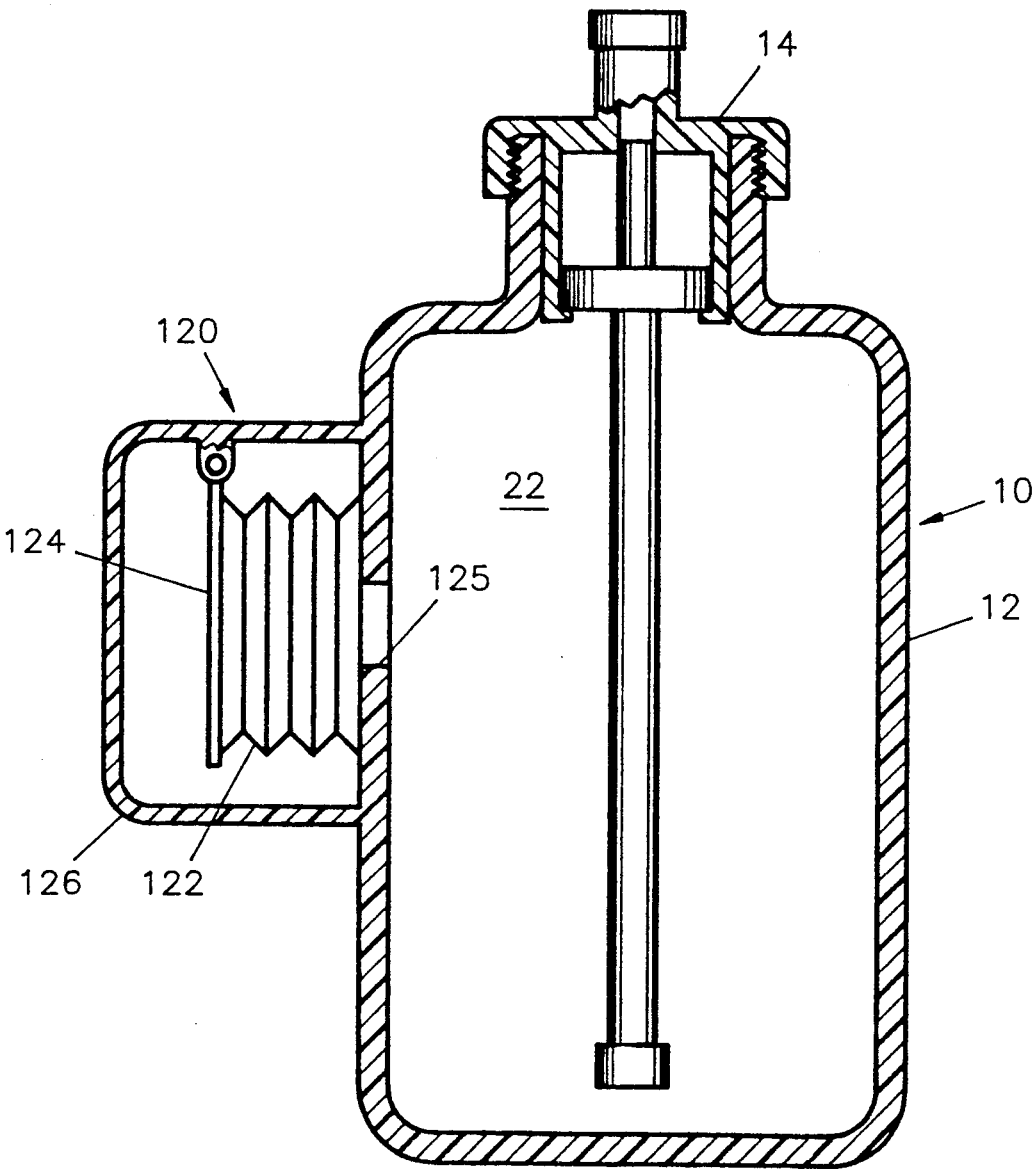
FIG. 5 is an overall cross-sectional view of one embodiment of the present invention including an alternative assembly for pressurizing the interior of the spray bottle container.

It is envisioned that other types of containers employing alternative mechanisms for applying pressure to their contents, such as bellows structures or squeeze triggers arranged for injecting air into the container, may be used in constructing spray bottles in accordance with the present invention. As shown in FIG. 5, an alternative assembly 120 for generating pressure within a spray bottle 10 is attached to the side of the rigid container 12. The assembly 120 includes a bellows structure 122, the interior of which is in communication with the interior 22 of the container 12 through a port 125. The bellows 122 may be compressed by squeezing a trigger 124 hinged on a guard structure 126 and pressurized air may thereby be injected into the container 12. Force applied to the trigger 124 accordingly results in an increase in pressure within the container 12 as required for operation of the dispensing pump 14 associated with the container 12.

It may also be apparent to those skilled in the art that not only free flowing liquids can comprise the container contents but also various other fluid materials such as fine powders or solids entrained in liquids or solutions or viscous liquids. In particular, the fluids which may be functional in the present invention include fluid slurries and solutions such as soaps and deodorants and other similar consumer products. The effectiveness of the present invention and the simplicity of its design make devices such as the spray bottle 10 shown in FIG. 1 commercially viable replacements for many conventional type aerosol cans using fluorocarbon propellants.

It should also be noted that the various fluids usable within the spray bottle of the present invention may be converted through the action of the dispensing pump 14 into different types of "media" of varying descriptions such as mists, fogs, aerosols, fluid streams and sprays of diverse patterns.

With the present invention in hand, it should be readily apparent to those skilled in this art that the single cylinder or bellows embodiments of, for instance, FIGS. 2 and 4, may be supplemented with one or more additional pressure multiplying means or sprayenhancing means. By way of example, one or more additional parallel or coaxial cylinders and pistons can be added to the embodiment of FIG. 2, or one or more additional bellows may be added to the embodiment of FIG. 4. Alternatively, the additional pressure chamber (either the piston or bellows) may be combined with a dissimilar pressure chamber, e.g., an additional bellows may be fitted coaxially about the piston 30 of FIG. 3.

Figure 6:
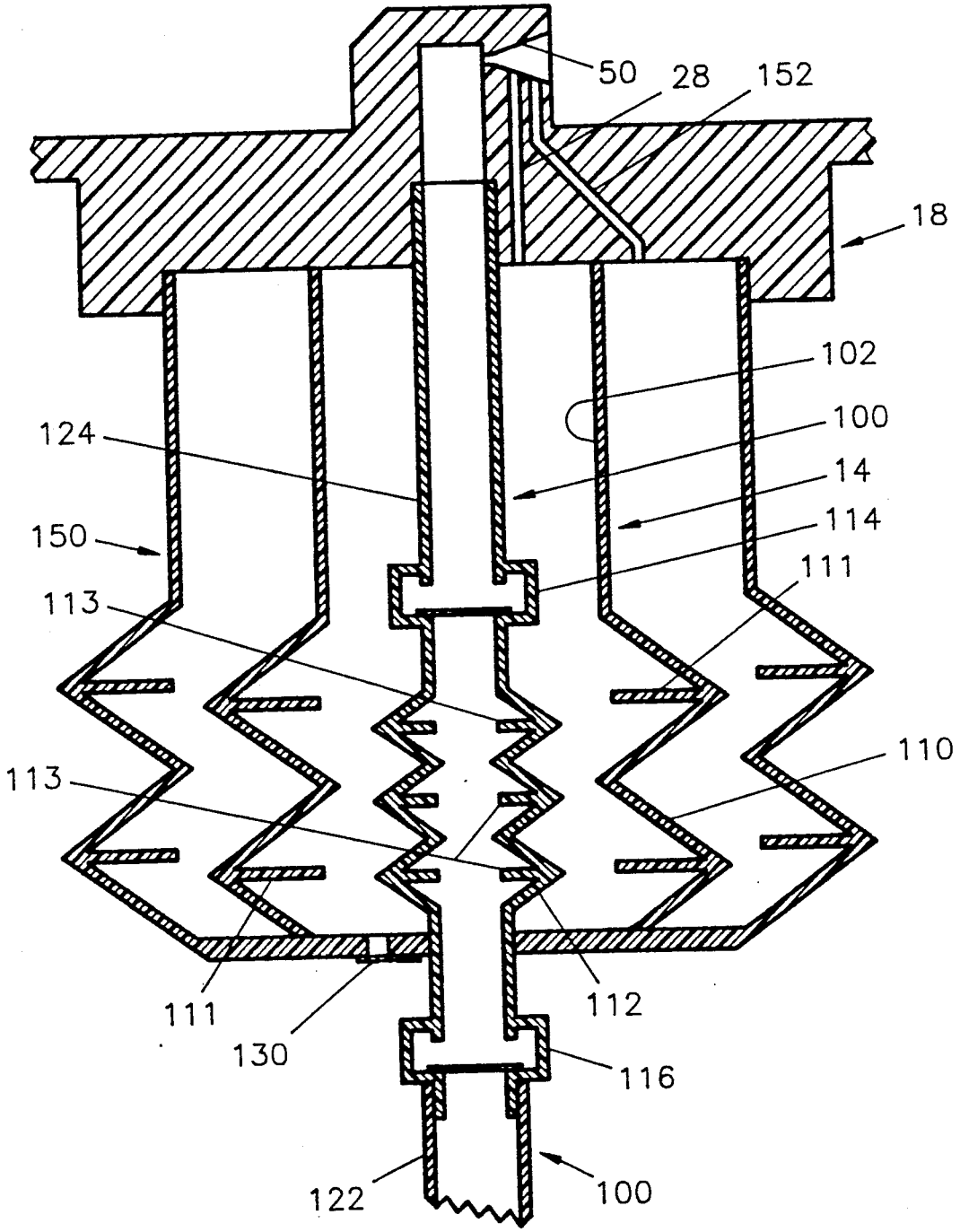
FIG. 6 is a cross-sectional view of an alternative embodiment of the dispensing fluid of FIG. 4.

By way of example, the apparatus of FIG. 4 can be modified with an additional co-axial bellows 150, as illustrated in FIG. 6, positioned outside the inner bellows 110. This additional bellows 150 is provided with a vent tube 152 intersecting the nozzle 50 adjacent the vent tube 28 and in fluid communication with outside ambient air. The bellows 150 will thus pump air under pressure into nozzle 50 to further disperse fluid exiting nozzle 50. The maximum pressure of the air exiting bellows 150 is determined by the relative areas of the co-axial bellows members 14 and 150. Of course, the outer bellows 150 may be adapted to dispense a fluid other than air (a "disparate fluid"), for example, a fluid contained within bellows 150 which is to be mixed with the fluid exiting supply tube 100. For the purposes of these additional embodiments, the "additional fluid" can be any liquid, powder, gel, etc., which is to be mixed with the primary fluid within bottle 10.

Figure 7:
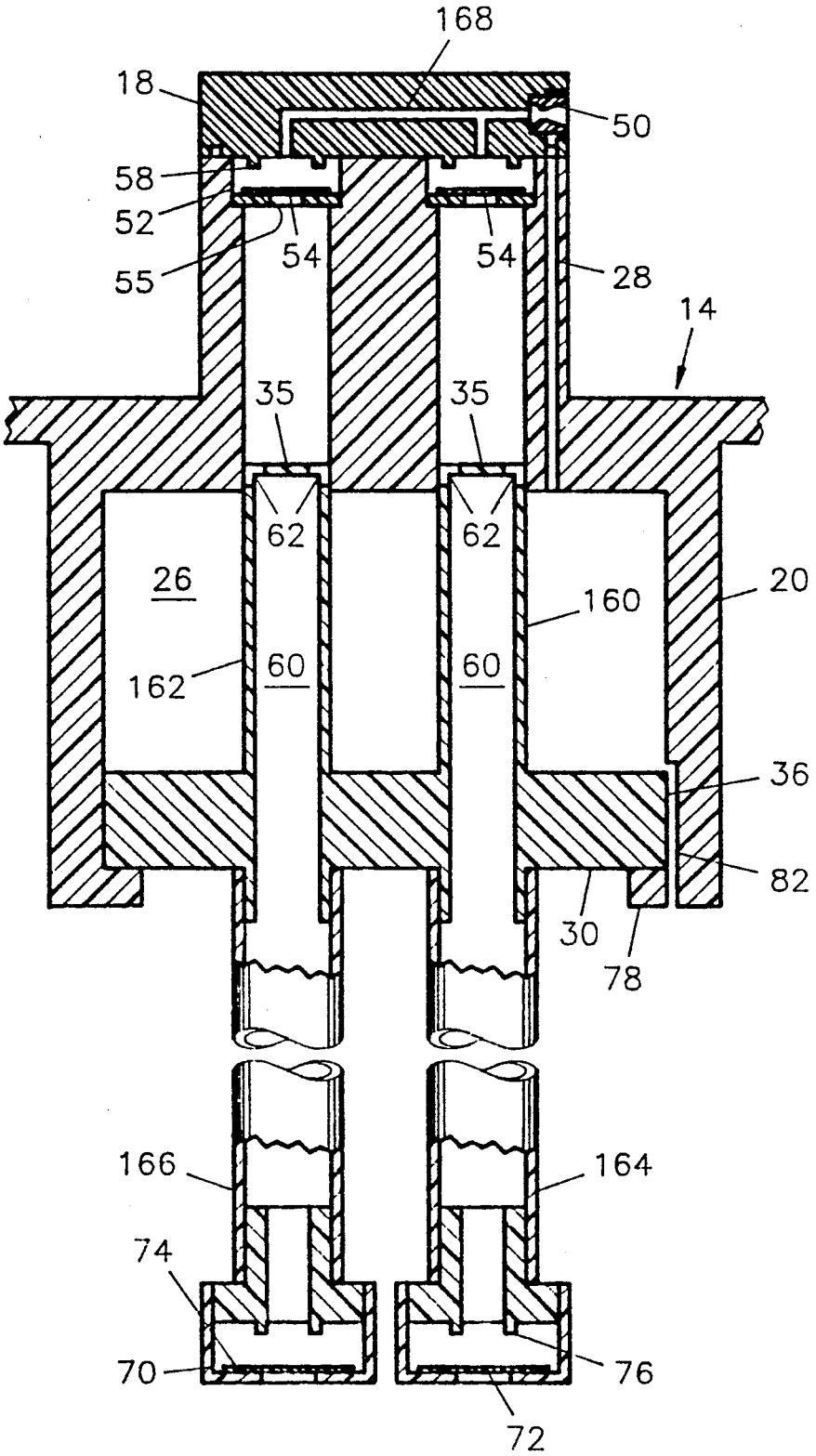
FIG. 7 is a cross-sectional view of an alternative embodiment of the dispensing pump of FIG. 2.

Another embodiment is illustrated in FIG. 7, wherein a pair of pistons 160, 162 are mounted to the hydraulic assembly 30. Each of pistons 160, 162 are provided with supply tubes 164, 166 in the same manner as that of FIG. 2. The supply tubes may be positioned within reservoirs (not shown) containing disparate fluids such that when the bottle 10 is squeezed, the disparate fluids exit the pistons 160, 162 and are mixed either in a common passage way 168, or in nozzle 50. In all other respects, the apparatus of FIG. 7 may be constructed the same as that illustrated in FIG. 2. It is to be appreciated that any number of pistons can be arranged adjacent one another as in FIG. 7, or they can be arranged in co-axial configuration as is illustrated with bellows in FIG. 6.

The disparate fluids used herein may be any different fluids which are preferentially maintained in separate and distinct containers prior to mixing at nozzle 50. By way of example only, such fluids may include a foaming agent and a carrier, a polymer and a hardening agent, etc.

While a preferred embodiment of the present invention has been shown and described, it will be apparent to those skilled in the art that many changes and modifications may be made without departing from the invention in its broader aspects. For example, the dispensing pump 14 may be mounted within the container 12 at or below the level of the fluid residing therein. The appended claims are therefore intended to cover all such changes and modifications as fall within the true spirit and scope of the invention.

I claim:

1. A spray bottle adapted for holding at least one fluid and producing a media of this fluid upon being squeezed, said spray bottle comprising:

(a) a resilient container for holding said at least one fluid within its interior;

(b) a fluid spray discharge member including a spray nozzle;

(c) a housing constructed and arranged for being mounted on said container, said housing including:

at least two high pressure chambers in controlled communication with said spray nozzle and a fluid within said container, and at least two pressure chambers in communication with the atmosphere outside said container;

(d) at least two hydraulic assemblies constructed and arranged to drive said fluid out through said nozzle at high pressure each of said hydraulic assemblies including:

a first piston which is slidably mounted in said high pressure chamber for applying pressure to any fluid within this chamber, and a second piston of greater diameter than said first piston which is slidably mounted in said low pressure chamber so as to partition this chamber off from the interior of said container and which is rigidly connected to said first piston so as to be movable therewith, said piston being operative for being displaced within said low pressure chamber when said bottle is squeezed; and (e) valve means for controlling the transfer of fluid into and out of each high pressure chamber so that fluid will flow out of said high pressure chamber through said nozzle when said bottle is squeezed and

2. A spray bottle adapted for holding a fluid within its interior and producing a media of this fluid upon being squeezed, said spray bottle comprising:

(a) a resilient container;

(b) a plurality of first chambers each having a fluid spray discharge member including a spray nozzle at one end thereof;

(c) a plurality of piston means interconnected to separate fluid sources containing disparate fluids, said piston means driving fluid through said plurality of first chambers and out through said nozzle;

(d) means for applying mechanical force to said plurality of piston means which is generated in response to the pressure inside said container as it is squeezed so that a hydraulic advantage may be achieved with respect to the pressure inside said chamber; and (e) valve means for controlling the supply of said fluid into said plurality of first chambers.

3. A spray bottle adapted for holding a fluid and producing a media of this fluid upon being squeezed, said spray bottle comprising:

(a) a resilient container for holding said fluid within its interior;

(b) a fluid spray discharge member including a spray nozzle;

(c) a plurality of first bellows mounted inside of said container and the interior of which is in communication with the atmosphere outside said container;

(d) a second bellows of smaller diameter than said first bellows which is mounted inside of and rigidly secured to said first bellows and the interior of which is in controlled communication with said spray nozzle and the fluid within said container;

(e) valve means for controlling the transfer of fluid into and out of one of said first bellows so that fluid will flow out of this bellows through said nozzle when said bottle is squeezed and into said bellows from said container as said bottle recovers from being squeezed; and (f) one of said first bellows being provided with a disparate fluid to be mixed with the fluid within the container when the fluids are ejected form the container.

4. The spray bottle of claim 3, wherein the said plurality of first bellows are arranged co-axially about one another.

5. A spray bottle adapted for holding a fluid and producing a media of this fluid upon being squeezed, said spray bottle comprising:

(a) a resilient container for holding said fluid within its interior;

(b) a fluid spray discharge member including a spray nozzle;

(c) at least two bellows exterior of the fluid spray discharge member and mounted inside of said container, the interior of each of said bellows being in communication with the atmosphere outside said container;

(d) valve means for controlling the transfer of fluid into and out of said bellows so that fluid will flow out of said bellows and be mixed at the nozzle when said bottle is squeezed and into said bellows from said container as said bottle recovers from being squeezed.

6. A spray bottle adapted for holding a fluid within its interior and producing a media of this fluid upon being squeezed, said spray bottle comprising:

(a) a resilient container;

(b) a plurality of first chambers each having a fluid spray discharge member including a spray nozzle at one end thereof;

(c) a plurality of piston means interconnected to separate fluid sources containing disparate fluids, said piston means for driving fluid through said plurality of first chambers and out through said nozzle;

(d) means to mix the disparate fluids upon ejection from the piston means;

(e) means for applying mechanical force to said plurality of first piston means which is generated in response to the pressure inside said container as it is squeezed so that a hydraulic advantage may be achieved with respect to the pressure inside said chamber; and (f) valve means for controlling the supply of said fluid into said plurality of first chambers.

* * * * *